US006585035B2

(12) United States Patent
Zobel et al.

(10) Patent No.: US 6,585,035 B2
(45) Date of Patent: Jul. 1, 2003

(54) TRANSMISSION FOR DRIVING A RADIAL FAN OF A VEHICLE COOLING UNIT

(75) Inventors: Werner Zobel, Boblingen (DE); Michael Ehlers, Nagold (DE); Frank Vetter, Filderstadt (DE); Jorg Soldner, Ehningen (DE); Roland Strähle, Unterensingen (DE); Wolfgang Knecht, Stuttgart (DE); Mark G. Voss, Franksville, WI (US); Andreas Willman, Tübingen (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/833,773

(22) Filed: Apr. 12, 2001

(65) Prior Publication Data

US 2001/0035282 A1 Nov. 1, 2001

(30) Foreign Application Priority Data

Apr. 12, 2000 (DE) ..... 100 18 090

(51) Int. Cl.[7] ..... B60H 1/00; B60H 3/00; F16H 7/12

(52) U.S. Cl. ..... 165/43; 165/125; 165/42; 123/41.49; 474/101; 474/133

(58) Field of Search ..... 165/41, 42, 43, 165/47, 51, 120, 125; 123/41.49; 474/133, 101; 74/490.14

(56) References Cited

U.S. PATENT DOCUMENTS

| | | | | | |
|---|---|---|---|---|---|
| 2,662,748 | A | * | 12/1953 | Huber | 165/125 X |
| 3,921,603 | A | * | 11/1975 | Bentz et al. | 165/51 X |
| 4,473,362 | A | * | 9/1984 | Thomey et al. | 474/133 X |
| 4,694,594 | A | * | 9/1987 | Thorud et al. | |
| 5,240,461 | A | * | 8/1993 | Hohnl | 474/101 |
| 5,358,452 | A | * | 10/1994 | Zhao | 474/133 |
| 6,098,385 | A | * | 8/2000 | Turk | 74/490.14 X |
| 6,129,056 | A | * | 10/2000 | Skeel et al. | 123/41.49 |
| 6,216,778 | B1 | * | 4/2001 | Corwin et al. | 165/41 X |
| 6,478,701 | B1 | * | 11/2002 | Yasuhara et al. | 474/133 X |
| 6,511,393 | B1 | * | 1/2003 | Bogl et al. | 474/101 |

FOREIGN PATENT DOCUMENTS

| | | |
|---|---|---|
| DE | 3912734 | 10/1990 |
| DE | 4117336 | 12/1992 |
| DE | 19950753 | 4/2001 |
| EP | 0020005 | 12/1980 |
| EP | 0393654 | 4/1990 |
| WO | 9845600 | 10/1998 |

OTHER PUBLICATIONS

Werner Zobel et al, "Radial Fan and Externally Controlled Viscous Clutch for Radial Truck Cooling System CCS™", VTMS Conference, May 1999.

* cited by examiner

*Primary Examiner*—Ljiljana Ciric
(74) *Attorney, Agent, or Firm*—Wood, Phillips, Katz, Clark & Mortimer

(57) ABSTRACT

A transmission drives a radial fan about a fan axis in a vehicle cooling unit including a plurality of heat exchangers arranged to surround the radial fan to receive a radial air flow therefrom. A driving pulley, a driven pulley, and a idler pulley of the heat exchangers.

3 Claims, 5 Drawing Sheets

TRANSMISSION FOR DRIVING A RADIAL FAN OF A VEHICLE COOLING UNIT

FIELD OF THE INVENTION

This invention relates to vehicle cooling unit or systems, such as radiators, air coolers, and condensers, and more particularly, to transmissions for driving a radial fan in a vehicle cooling unit including a plurality of heat exchangers arranged to surround the radial fan to receive a radial air flow therefrom.

BACKGROUND OF THE INVENTION

Vehicle cooling systems or units are know wherein a plurality of heat exchangers surround a radial fan in a box-like arrangement to receive a radial air flow therefrom.

One example of such a system is shown in unpublished application DE 199 50 753.8, which discloses a box-like radiator having a recessed rear wall in which a drive shaft of a radial fan is mounted and is equipped with a connection flange. The fan drive itself is characterized as being primarily situated in the space made available by the recessed rear wall.

A fan drive is shown in DE 41 17 336 A1 that can compensate for the relative movements between the engine and cooling unit. This is achieved by a motion compensation device arranged between the engine and fan and which is designed in a preferred example as an expansion bellows. The expansion bellows might have some advantages relative to known elastic shafts, but has thus far not gained acceptance, presumably because its suitability in long-term operation is restricted, since such an expansion bellows is subject to enormous stresses, which the employed materials may not withstand.

Fans in vehicles are often driven by means of drive belts, such as V-belts, which are arranged between a pulley on the crankshaft of the engine and a pulley on the shaft of the fan. To equalize the above mentioned relative movements and to counteract expansion of the V-belt, the V-belt additionally runs over a moving idler pulley. The moving idler pulley and the driving pulley are conventionally fastened to the engine housing. The engine also drives other auxiliary machines, like water pumps, hydraulic pumps, compressors and generators with the drive belt, so that, in many cases, a design restriction is produced, which hampers accessibility in the case of inspection and maintenance activities.

At the VTMS Conference in May 1999, three principles for arrangement and connection of the engine on the drive side to the fan of the radiator were presented. The first principle, attaches the radiator on the frame of the vehicle and mounts the fan on the radiator. This principle is shown in the previously mentioned DE 41 17 336 A1. This principle also is shown in WO 98/45600, which discloses a box-like cooling unit with a belt drive for the fan. In the second principle, the radiator and fan are mounted directly on the engine, whereas, in the third principle, the radiator is fastened to the frame and the fan is mounted on the crankshaft of the engine.

While many of the known cooling units may perform satisfactorily for their intended purpose, there is always room for improvement. For example, improvements may be made in terms of compactness, reliability of long-term operation, and ease of assembly.

SUMMARY OF THE INVENTION

According to one form of the invention, a transmission is provided for driving a radial fan about a fan axis in a vehicle cooling unit including a plurality of heat exchangers arranged to surround the radial fan to receive a radial air flow therefrom. The radial fan receives an axial air flow from a front end of the cooling unit. At least one of the heat exchangers has a rearmost edge that defines a back end plane transverse to the fan axis, with none of the other heat exchangers having a rearmost edge that extends rearward beyond the back end plane. The transmission includes a driven pulley mounted to the cooling unit for rotation about the fan axis and connected to the radial fan to transmit a drive torque thereto, a driving pulley having an axis of rotation substantially parallel to the fan axis and spaced radially from the fan axis, at least one drive belt extending from the driving pulley to the driven pulley to transmit drive torque thereto, a tensioning lever mounted to pivot about a pivot axis that is substantially parallel to the fan axis and spaced radially from the fan axis, and an idler pulley mounted on the tensioning lever for rotation about an axis that is substantially parallel to the fan axis and spaced from the fan axis, the pivot axis, and the axis of rotation of the driving pulley. The idler pulley is engageable with the drive belt.

In a preferred embodiment, the driving pulley, the driven pulley, and the idler pulley do not extend rearward beyond the back end plane.

In one form, an operating cylinder is engaged with the tensioning lever to selectively urge the tensioning lever to pivot about the pivot axis.

The invention is described below in practical examples, from which additional features and advantages of the invention follow.

DETAILED DESCRIPTION OF THE PREFERRED EMBODIMENTS

Figure 1:
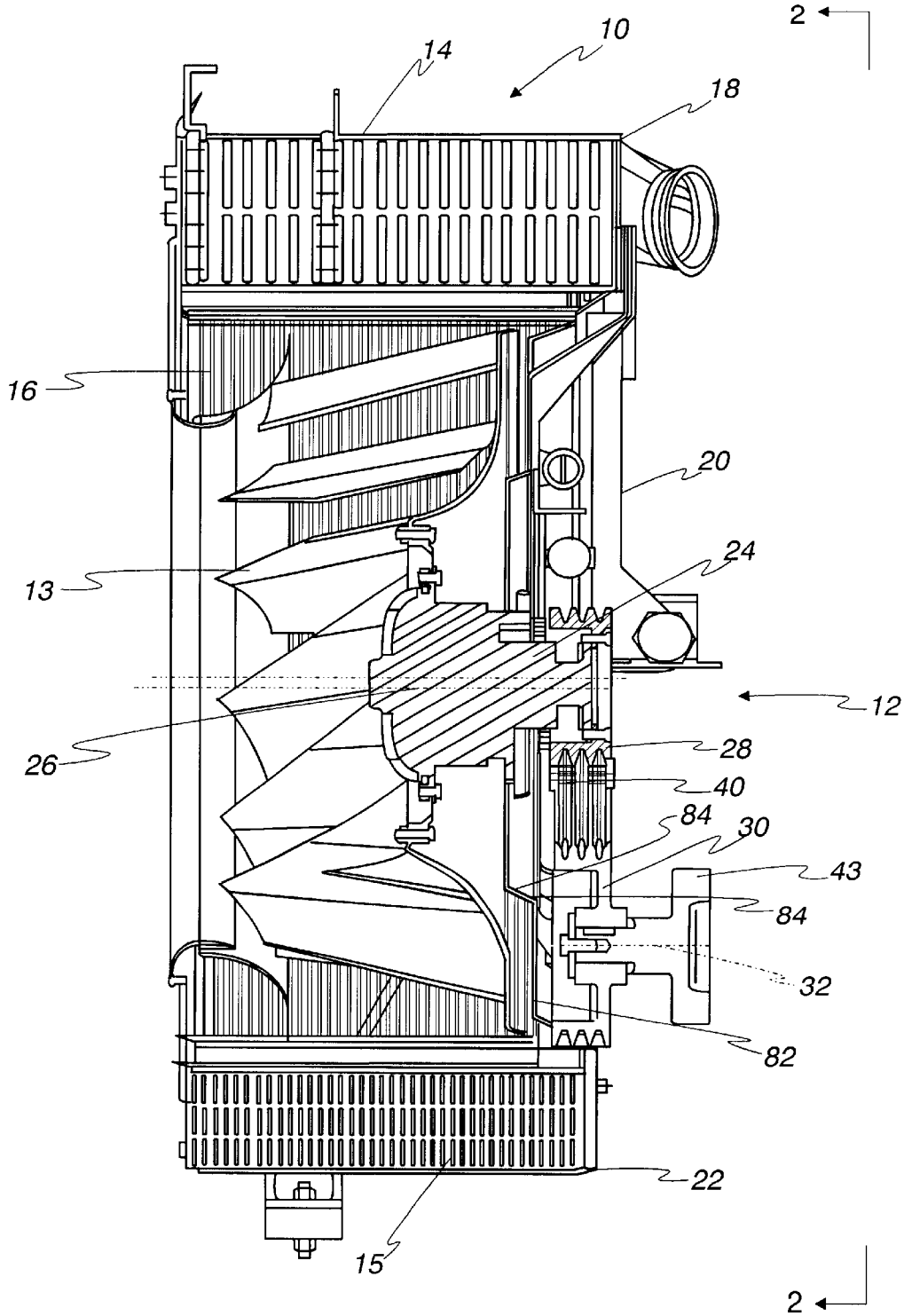
FIG. 1 is a sectional view of a box-like cooling unit including a transmission embodying the present invention.

A cooling unit 10 including a fan drive transmission 12 embodying the present invention is shown in FIGS. 1–4. As best seen in FIG. 1, the cooling unit 10 includes a radial fan 13 and a plurality of different heat exchangers or coolers 14, 15, and 16 with an additional cooler (not shown) situated opposite the cooler 16, so that the cooling unit 10 has a cooler on all four sides in a box-like arrangement to receive a radial air flow from the fan 13. While it is preferred that each of the coolers of the cooling unit 10 provide cooling to a different media from the media of the other coolers, it should be understood that two or more of the coolers can be interconnected so that different coolers are no longer involved. For example, the coolers 15 and 16 could be interconnected to be a common coolant cooler. In the illustrated embodiment, the upper cooler 14 is a charge air cooler and has a rear most edge 18 that defines a back end plane 20. None of the other coolers of the cooling unit 10 have rear edges that extend rearward beyond the back end plane 20. For example, it can be seen in FIG. 1 that the rear edge 22 of the cooler 15 is situated forward of the back end of plane 20.

Figure 3:
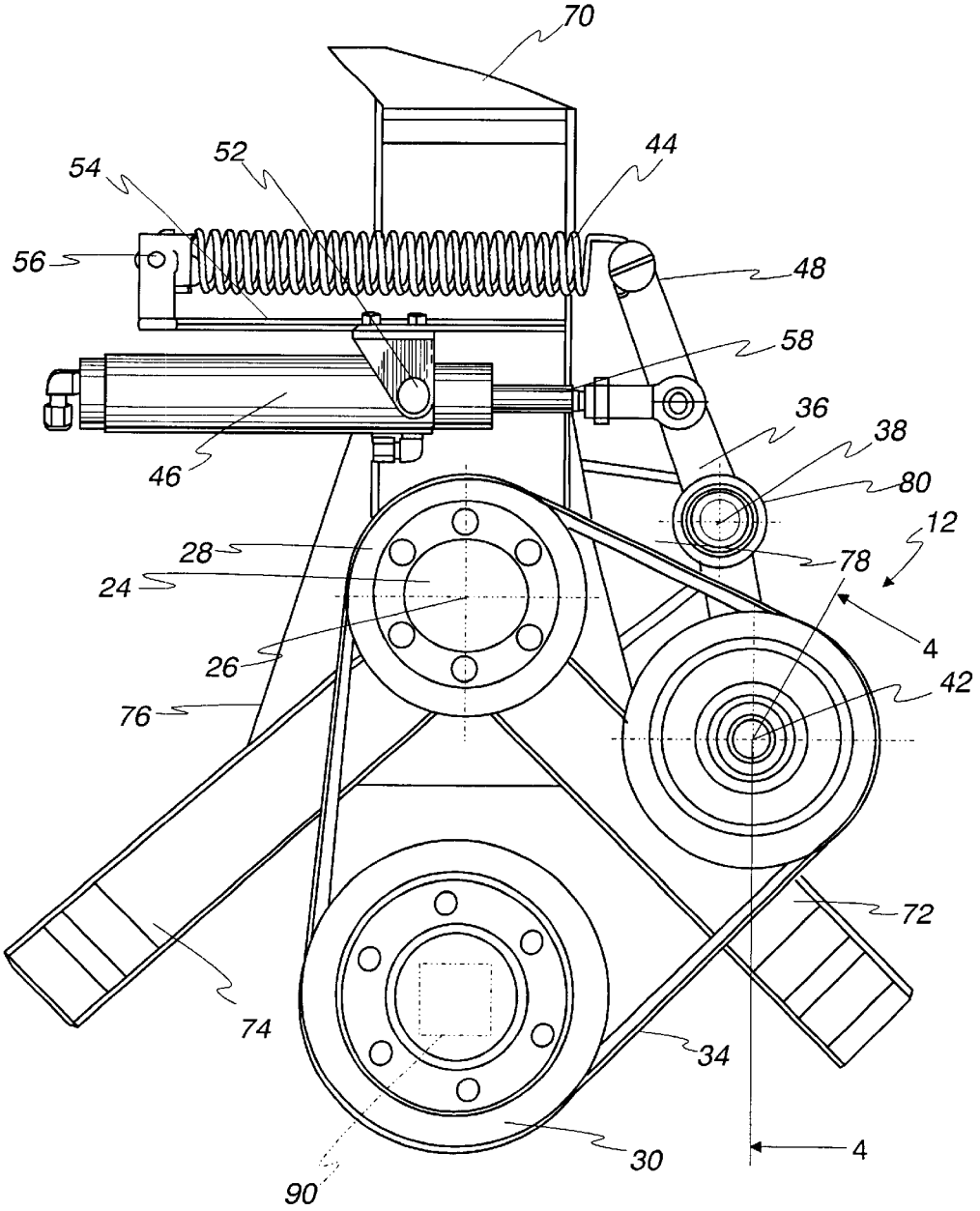
FIG. 3 is an enlarged view similar to FIG. 2, showing the transmission from FIG. 1.
Figure 4:
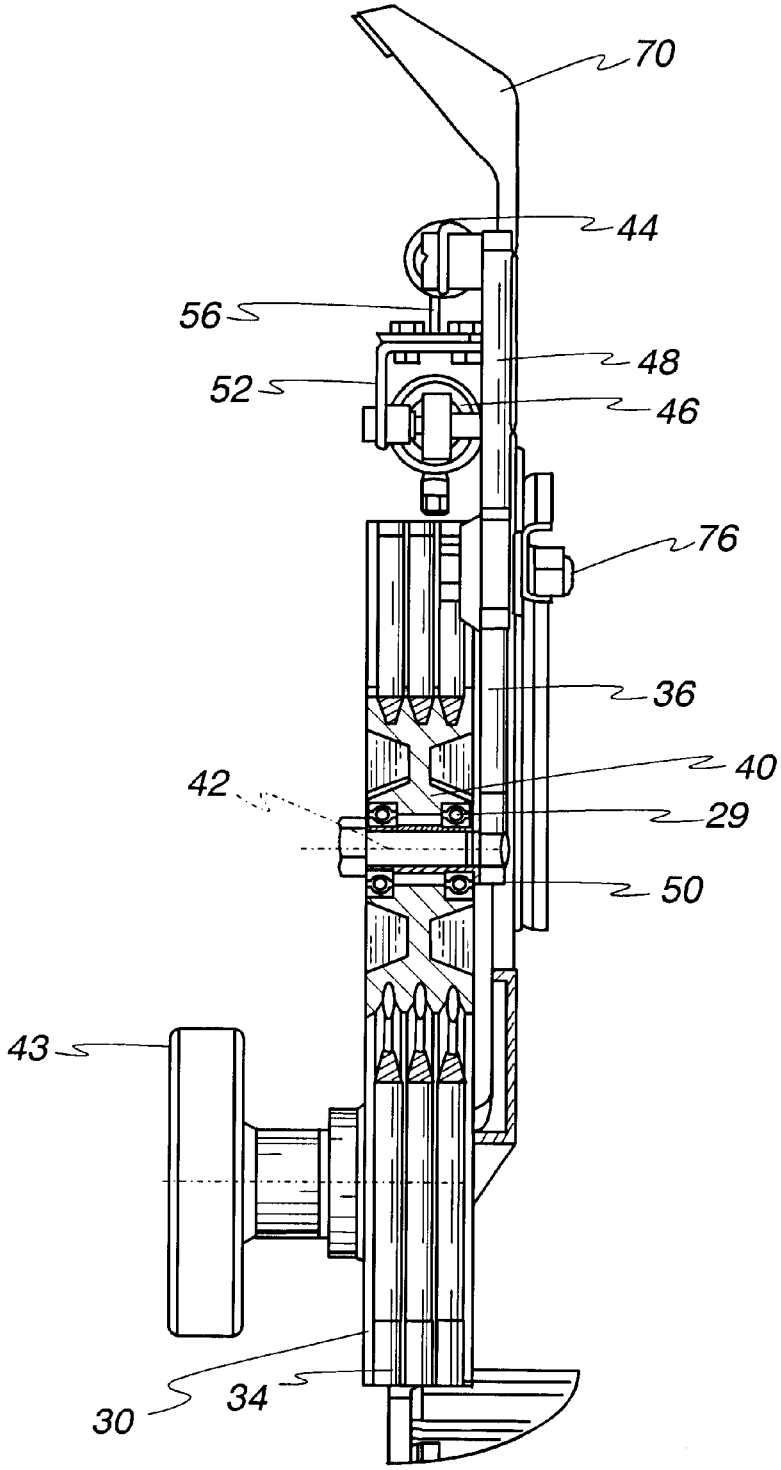
FIG. 4 is a sectional view taken essentially along line 4—4 in FIG. 3.

As best seen in FIGS. 1 and 3, the transmission 12 includes a drive device 24 that mounts the fan 13 for rotation about a fan axis 26 that is centered in the cooling unit 10, a driven pulley 28 that is mounted for rotation about the axis 26 and connected to the radial fan 13 by the drive 24, a driving pulley 30 having an axis of rotation 32 substantially parallel to fan axis 26 and spaced radially from the fan axis 26, a plurality of drive belts in the form of V-belts 34 extending from the driving pulley 30 to the driven pulley 28 to transmit drive torque thereto, a tensioning lever 36 mounted to pivot about a pivot axis 38 that is substantially parallel to the fan axis 26 and spaced radially from the fan axis 26, and an idler pulley 40 mounted on the tensioning lever 28 for rotation about an axis 42 that is substantially parallel to the fan axis 26 and spaced radially from the fan axis 26, the pivot axis 38, and the axis of rotation 32 of the driving pulley 30. The V-belts 34 are also engaged around the idler pulley 40. The drive device 24 is preferably a stepless, switchable coupling, for example, a viscocoupling or an electromagnetic coupling. As seen in FIG. 1, the driven pulley 28, the driving pulley 30, and the idler pulley 40 do not extend rearward beyond the back end of plane 20. As shown in FIGS. 1 and 4, a connection flange 43, to which a drive shaft (not shown) of an engine can be connected, is rotatably fixed to the driving pulley 30 to transmit drive torque thereto.

As best seen in FIGS. 3 and 4, the transmission 12 further includes a tension spring 44 and a pneumatic cylinder 46 that are engaged with an end 48 of the tensioning lever 36 opposite an end 50 of the tensioning lever 36 to which the idler pulley 40 is rotatably mounted. A common bracket 52 mounts the tension spring 44 and the pneumatic cylinder 46 to the cooling unit 10, with a rail 54 and counter support 56 extending therefrom to engage the end of the tension spring 44 opposite from the lever 36. The cylinder 46 includes a cylinder rod 58 that is connected to the tensioning lever 36. The tension spring 44 serves to maintain belt tension during operation. In a preferred embodiment, the cylinder rod 58 can be selectively retracted to assist the tension spring 44 in maintaining optimum belt tension during operation. Lateral and/or vertical relative movements are possible because the moving idler pulley 40 can ensure that the V-belts 34 are under optimal tension in all operating situations. In this regard, when the idler pulley 40 and the tensioning lever 36 move to accommodate relative motion between the cooling unit 10 and an engine that carries the driving pulley 30, the cylinder 46 can provide an essentially constant force on the tensioning lever 36 because the cylinder 46, in combination with the pneumatic system of the vehicle, can be configured to maintain an essentially constant cylinder pressure on the rod 58 as it translates in the cylinder 46 to accommodate the pivoting of the tensioning lever 36. This helps to maintain the optimum belt tension by compensating for the variability in the spring force caused by the movement of the tensioning lever 36 and the spring rate of the spring 44. Further, because the cylinder 46 can maintain a significant force on the tensioning lever 36, the use of the cylinder 46 to load the idler pulley 40 can allow for a smaller angle of wrap of the belt(s) 34 around the driven pulley 28 and/or the driving pulley 30 than may otherwise be practical with the use of a spring alone when significant lateral and/or vertical relative movement between the cooling unit 10 and an engine must be accommodated. In this regard, it is preferred that the cylinder 46 provide a majority of the force on the tensioning lever 36 during operation. However, in some applications, for example in applications where there is little relative lateral and/or vertical movement between the cooling unit 10 and the associated engine, it may be advantageous for the spring 44 to provide the majority of the force on the tensioning lever 36 during operation. Additionally, in some applications it may be advantageous for the pneumatic cylinder 46 to be configured to provide damping to the tensioning lever 36 through gas compression and/or the provision of one or more damping orifices in the cylinder 46 or the pneumatic system of the vehicle. Preferably, the pneumatic cylinder 46 is a double acting pneumatic cylinder with a piston rod 58 that can be extended against the force of the spring 44 to pivot the tensioning lever 36 about the axis 38 so that the idler pulley 40 occupies a position in which removal of the V-belts 34 can occur. In this regard, a pneumatic cylinder is particular advantageous when the cooling unit 10 is employed in a vehicle, such as some trucks, having compressed air that is readily available and that can be used when the vehicle is stopped. While the illustrated arrangement of the spring 44 and cylinder 46 is preferred, in some applications it may be advantages to replace the spring 44 with a compression spring positioned inside of the cylinder 46 to retract the rod 58. Further, in some applications it may be advantages for the cylinder 46 to be a single action cylinder that would provide either the loading of the idler pulley 40 during operation or the unloading of the idler pulley for belt replacement, but not both. While the tension spring 44 and pneumatic cylinder 46 are preferred, a known tensioning element can be used instead which combine both functions. Such a tensioning element, which has a tension spring with a damping element, is disclosed in DE 40 39 815. If such a tensioning element is employed, a pivotable counter support should be provided in order to assist in the changing of the V-belts 34.

Figure 2:
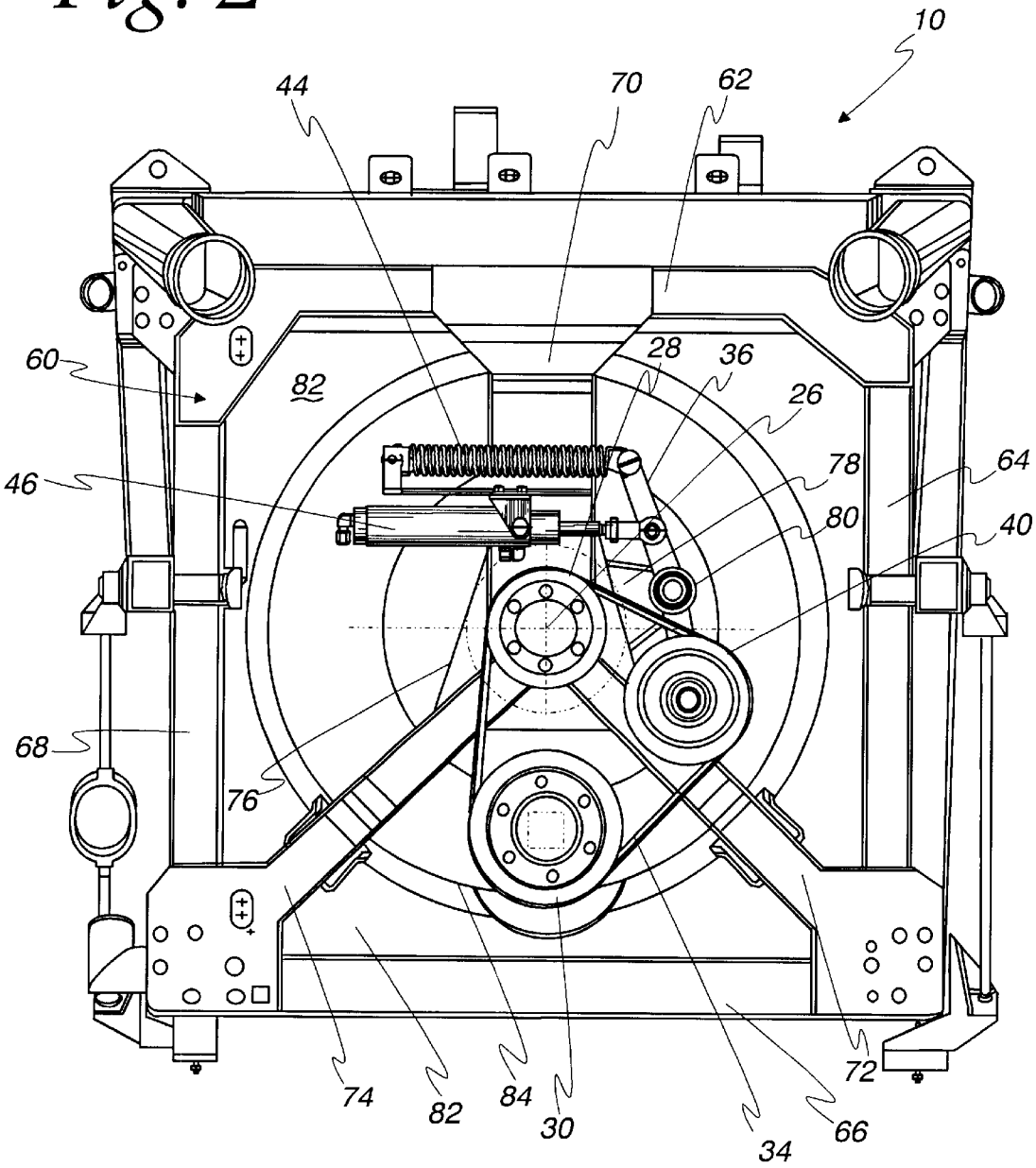
FIG. 2 is a view from the back of the cooling unit taken from line 2—2 in FIG. 1.

As best seen in FIG. 2, the cooling unit 10 includes a rear wall 60 with a frame construction having four sides 62, 64, 66, and 68, preferably of profiled aluminum. Three support struts, 70, 72, and 74 extends from the sides 62, 64, 66, and 68 to a center structure 76 to mount the drive 24. A support 78 is connected to and extends from the center structure 76 to mount the tension lever 36 via a pivot 80. As an alternate construction, rather then being connected to the center structure 76, the support 78 could be connected to the frame construction of the rear wall 60. As best seen in FIGS. 1 and 2, a cover 82 is fastened between the struts 70, 72 and 74, and has a step 84 that leads further into the interior of the cooling unit 10 and, in the illustrated embodiment, is circular. Preferably, the cover 82 is made of plastic or aluminum sheet. The cover 82 has stiffening beads or similar features that increase stability, which are known from light metal construction.

Because the idler pulley 40 with all of its functional parts is moved away from the engine onto the rear wall 60 of the cooling unit 10, both the accessibility for maintenance work or the like and assembly of the cooling unit with an engine are improved.

Figure 5:
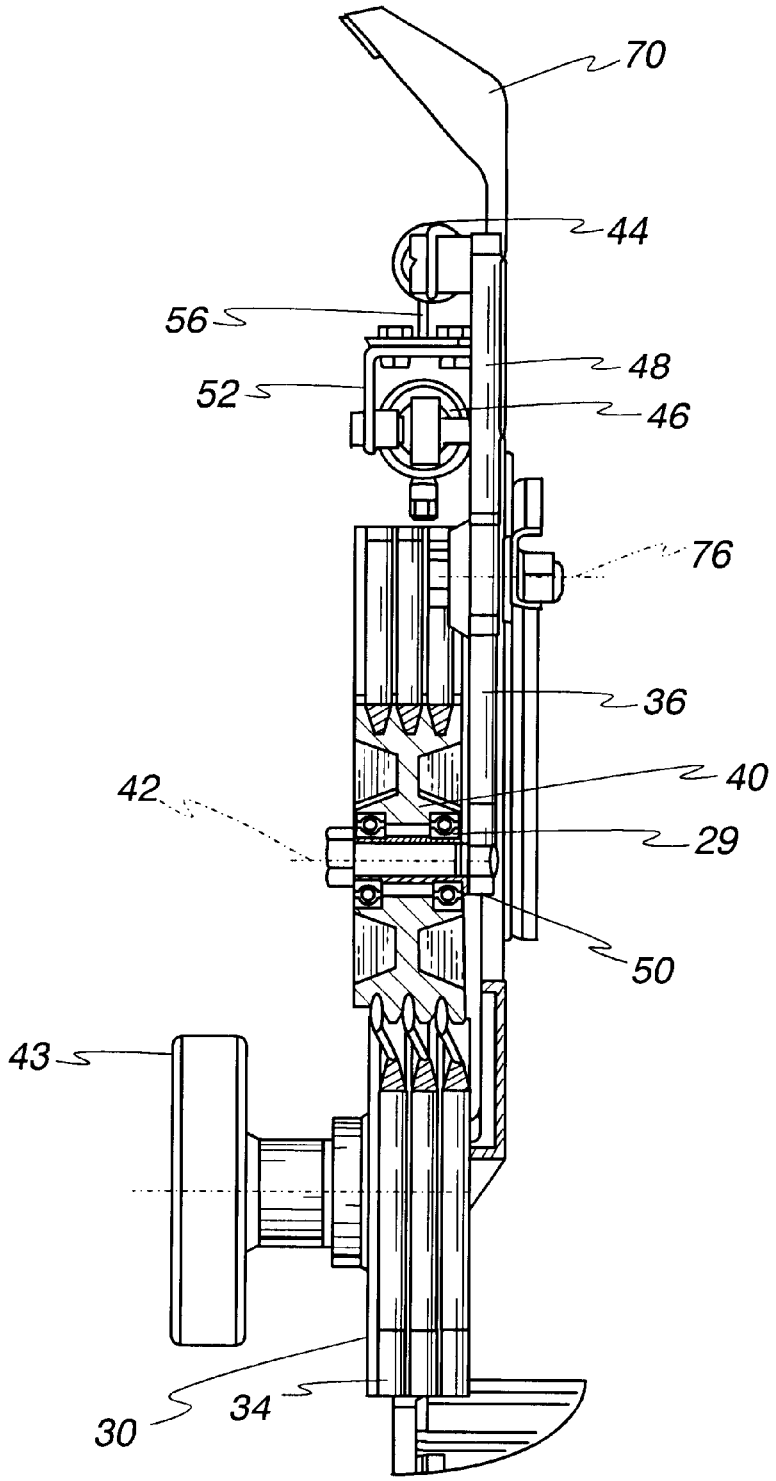
FIG. 5 is a view similar to FIG. 4 showing an alternate embodiment.

It can be seen in FIGS. 3 and 4 that the pulleys 28, 30 and 40 are all arranged in a common plane. However, as shown in FIG. 5, it may be advantageous in some applications to offset the pulleys 28, 30 and 40 relative to each other so that they do not all lie in a common plane. For example, the pulleys 28, 30 and 40 can be arranged offset relative to each other when the incorporation or space conditions in the vehicle require this. The size of the possible offset will typically lie within relatively narrow limits.

The plane formed by the driven pulley 28, the driving pulley 30 and the idler pulley 40 is situated within the recessed rear wall 60, so that only very little additional design space is required. Thus, the spacing between the engine and the cooling unit 10 can be substantially reduced, so that design space is saved. It is preferred that all of the components of the transmission 12, with the exception of the connection flange 43, be situated in front of or in the plane 20 in which the rear edge 18 arranged farthest rearward lies.

The cooling unit 10 is equipped with the complete fan drive or transmission 12, which now represents a part of the cooling unit 10, so that, during assembly in a vehicle, only fastening of the cooling unit 10 on the frame of the vehicle and connection between the crankshaft of the engine and the above mentioned connection flange 43 must occur.

The pulleys 28 and 30, in one variant of the inventive idea, can be multiple pulleys and/or offer the possibility of varying the torques and speeds to be transferred. For example, one of the pulleys 28 and 30 can be designed in two parts that can be pushed together or apart as a function of torque, so that the V-belts 34 running in the pulley move closer to or farther from the axis of the pulley, which leads to altered speeds. The speed-varying devices required for this belong to the prior art and are shown schematically at 90 in FIG. 3. A belt drive that offers these possibilities is apparent, for example, from EP 0 020 005, and therefore need not be described in detail. If this variant is chosen, the drive device 24 of the fan 13 can be a drive shaft.

The number, configuration, and arrangement of support struts 70, 72, and 74, generally designed as profiles on the rear wall 60, can be different then illustrated. The rear wall 60 will primarily be a four-sided frame construction. However, it is also possible to dispense with the four-sided frame and to guide four support struts radially from the corners to the center, as was shown in the previously unpublished application DE 199 50 753.8. The design of the rear wall there, at least with reference to arrangement of the support struts, should also be referred to for the present application. This support construction of the rear wall preferably consists of aluminum and can be designed both as a welded construction and also die-cast aluminum.

We claim:

1. A transmission for driving a radial fan about a fan axis in a vehicle cooling unit including a plurality of heat exchangers arranged to surround the radial fan to receive a radial airflow therefrom, the radial fan receiving an axial air flow from a front end of the cooling unit, at least one of the heat exchangers having a rearmost edge that defines a back end plane transverse to the fan axis, none of the heat exchangers having a rearmost edge that extends rearward beyond the back end plane, the transmission comprising:

a driven pulley mounted to the cooling unit for rotation about the fan axis;

a drive connected to the driven pulley and adapted to connect the driven pulley to the radial fan to transmit a drive torque from the driven pulley to the radial fan, the drive being a drive shaft and one of the driven and driving pulleys being equipped with speed-varying devices;

a driving pulley having an axis of rotation substantially parallel to the fan axis and spaced radially from the fan axis;

a least one drive belt extending from the driving pulley to the driven pulley to transmit the drive torque thereto;

a tensioning lever mounted to the cooling unit to pivot about an pivot axis that is substantially parallel to the fan axis and spaced radially from the fan axis; and an idler pulley mounted to the cooling unit on the tensioning lever for rotation about an axis that is substantially parallel to the fan axis and spaced from the fan axis, and the axis of rotation of the driving pulley, the idler pulley engageable with the at least one drive belt;

wherein the driving pulley, the driven pulley, and the idler pulley do not extend rearward beyond the back end plane.

2. A transmission for driving a radial fan about a fan axis in a vehicle cooling unit including a plurality of heat exchangers arranged to surround the radial fan to receive a radial airflow therefrom, the radial fan receiving an axial air flow from a front end of the cooling unit, at least one of the heat exchangers having a rearmost edge that defines a back end plane transverse to the fan axis, none of the heat exchangers having a rearmost edge that extends rearward beyond the back end plane, the transmission comprising:

a driven pulley mounted to the cooling unit for rotation about the fan axis;

a drive connected to the driven pulley and adapted to connect the driven pulley to the radial fan to transmit a drive torque from the driven pulley to the radial fan, the drive being a stepless, switchable coupling;

a driving pulley having an axis of rotation substantially parallel to the fan axis and spaced radially from the fan axis;

at least one drive belt extending from the driving pulley to the driven pulley to transmit the drive torque thereto;

a tensioning lever mounted to the cooling unit to pivot about an pivot axis that is substantially parallel to the fan axis and spaced radially from the fan axis; and an idler pulley mounted to the cooling unit on the tensioning lever for rotation about an axis that is substantially parallel to the fan axis and spaced from the fan axis, and the axis of rotation of the driving pulley, the idler pulley engageable with the at least one drive belt;

wherein the driving pulley, the driven pulley, and the idler pulley do not extend rearward beyond the back end plane.

3. A transmission for driving a radial fan about a fan axis in a vehicle cooling unit including a plurality of heat exchangers arranged to surround the radial fan to receive a radial airflow therefrom, the radial fan receiving an axial air flow from a front end of the cooling unit, at least one of the heat exchangers having a rearmost edge that defines a back end plane transverse to the fan axis, none of the heat exchangers having a rearmost edge that extends rearward beyond the back end plane, the transmission comprising:

a driven pulley mounted to the cooling unit for rotation about the fan axis and connected to the radial fan to transmit a drive torque thereto;

a driving pulley having an axis of rotation substantially parallel to the fan axis and spaced radially from the fan axis;

at least one drive belt extending from the driving pulley to the driven pulley to transmit drive torque thereto;

a tensioning lever mounted to the cooling unit to pivot about an pivot axis that is substantially parallel to the fan axis and spaced radially from the fan axis;

an idler pulley mounted to the cooling unit on the tensioning lever for rotation about an axis that is substantially parallel to the fan axis and spaced from the fan axis, and the axis of rotation of the driving pulley, the idler pulley engageable with the at least one drive belt; and at least one tension element attached to the tensioning lever, the at least one tension element comprising two tension elements, one of which is a tension spring and the other a double-acting, pneumatically loadable operating cylinder;

wherein the driving pulley, the driven pulley, and the idler pulley do not extend rearward beyond the back end plane.

* * * * *